US006670740B2

(12) United States Patent
Landon, Jr.

(10) Patent No.: US 6,670,740 B2
(45) Date of Patent: Dec. 30, 2003

(54) HIGH ELECTRICAL STICTION SPARK PLUG

(76) Inventor: William W. Landon, Jr., 18 Craigemore Cir., Avon, CT (US) 06001

( * ) Notice: Subject to any disclaimer, the term of this patent is extended or adjusted under 35 U.S.C. 154(b) by 176 days.

(21) Appl. No.: 09/943,105

(22) Filed: Aug. 30, 2001

(65) Prior Publication Data

US 2002/0030427 A1 Mar. 14, 2002

Related U.S. Application Data

(63) Continuation-in-part of application No. 09/552,184, filed on Apr. 18, 2000, now abandoned.

(60) Provisional application No. 60/133,778, filed on May 12, 1999.

(51) Int. Cl.[7] ..... H01T 13/20; H01T 21/02; F01L 3/00

(52) U.S. Cl. ..... 313/141; 313/139; 313/140; 313/143; 313/118; 123/189 EL; 445/7

(58) Field of Search ..... 313/139, 141, 313/140, 143, 118; 123/189 EL; 445/7

(56) References Cited

U.S. PATENT DOCUMENTS

| | | | | |
|---|---|---|---|---|
| 2,489,410 A | | 11/1949 | Hahn | 123/169 |
| 2,531,638 A | | 11/1950 | Miller | 315/57 |
| 2,760,099 A | | 8/1956 | Suter | 313/131 |
| 2,831,138 A | | 4/1958 | Teasel | 313/130 |
| 2,871,389 A | | 1/1959 | Skunda | 313/144 |
| 2,874,322 A | | 2/1959 | Bychinsky | 313/131 |
| 3,202,859 A | | 8/1965 | Knaggs | 313/130 |
| 3,229,032 A | | 1/1966 | Willis | 174/152 |
| 3,394,285 A | | 7/1968 | Lindsay | 315/58 |
| 3,538,372 A | | 11/1970 | Terao | 313/131 |
| 3,706,897 A | | 12/1972 | Shepardson | 313/141 |
| 3,958,144 A | | 5/1976 | Franks | 313/141 |
| 3,988,646 A | | 10/1976 | Atkins et al. | 317/96 |
| 4,374,450 A | | 2/1983 | Warren et al. | 445/7 |
| 4,419,601 A | | 12/1983 | Hamai et al. | 313/131 |
| 5,408,961 A | * | 4/1995 | Smith | 123/169 R |
| 5,461,276 A | * | 10/1995 | Matsutani et al. | 313/141 |
| 5,892,319 A | | 4/1999 | Rossi | 313/141 |
| 5,936,332 A | | 8/1999 | Krupa et al. | 313/141 |

* cited by examiner

*Primary Examiner*—Nimeshkumar D. Patel
*Assistant Examiner*—Matt P Hodges
(74) *Attorney, Agent, or Firm*—McCormick, Paulding & Huber LLP

(57) ABSTRACT

A spark plug includes a sparking electrode with a firing tip and a ground electrode. The ground electrode includes a toroidal member, having a convex outer surface, coupled to a support portion of a sleeve of the ground electrode. The toroidal member forms an annular curve disposed generally transverse to and having a radial center coinciding with a central axis of the insulator body, whereby each differential segment of the toroidal member radially thereabout is generally equidistant to the firing tip. The toroidal member is a closest portion of the ground electrode relative to the firing tip. At least a portion of the outer surface of the toroidal member opposing the firing tip has a radius of curvature of about that of the firing tip for providing a spark path of least from the firing tip to a point of contact on the opposing surface defined by the toroidal member.

19 Claims, 1 Drawing Sheet

HIGH ELECTRICAL STICTION SPARK PLUG

CROSS REFERENCE TO RELATED APPLICATION

This is a continuation-in-part of application Ser. No. 09/552,184, filed Apr. 18, 2000 now abandoned, which claims the benefit of U.S. Provisional Application No. 60/133,778, filed May 12, 1999.

FIELD OF THE INVENTION

The present invention is directed generally to spark plugs, and more particularly to a spark plug employing matching opposing convex surfaces as the spark plug gap.

BACKGROUND OF THE INVENTION

Prior spark plugs typically provide gap electrodes that are flat and parallel or round and symmetrical (i.e., circular convex to circular concave). One such spark plug provides one or more prongs disposed over the tip of a center or sparking electrode. Such spark plugs generate a spark at the outermost tip of the center electrode which results in the gradual build-up of carbon on the tips of the central electrode and the prongs. The carbon build-up leads to a reduced capacity or failure in generating a spark for igniting the fuel/air mixture in an internal combustion engine. Further, the prongs tend to need re-gapping because of electrical use wear and any unwanted bending of the prongs which can occur during periodic cleaning of the spark plug electrodes.

In order to lengthen operational life, another type of spark plug has a disk-like terminal head concentrically located in spaced relation within a cylindrical ground electrode to provide an annular sparking gap between the ground electrode and the entire circumference of the disk-like terminal head of the sparking electrode. Thus, in this type of spark plug, firing may occur across the annular sparking gap anywhere along its circumferential length and therefore less fouling will occur as compared with spark plugs having a single point-to-point contact between a central electrode and a ground electrode prong. A drawback with spark plugs with annular sparking gaps, however, is that the center electrode and insulator are typically not exposed to enough of the fuel/air mixture to prevent fouling and are susceptible to damage resulting from, for example, accidental dropping of the spark plug. Further, the insulator member of such spark plugs typically does not have enough exposure to the fuel/air mixture for allowing sufficient cooling to prevent an associated insulator heat build-up which can in turn lead to cracking or insulator resistance breakdown.

In view of the foregoing, it is a general object of the present invention to provide a spark plug which overcomes the above-mentioned drawbacks associated with the use and operational life of prior art spark plugs.

SUMMARY OF THE INVENTION

In a first aspect of the present invention, a spark plug includes an elongated electrical insulator body defining a first bore extending longitudinally along a central axis of the body from a connector end to a firing end. A sparking electrode communicates with the first bore. The sparking electrode includes a firing tip defining a convex outer surface generally having a radius of curvature. The firing tip has an outermost point generally coinciding with the central axis. A ground electrode includes a sleeve having a support portion adjacent to the firing tip of the sparking electrode.

The sleeve defines a second bore accommodating at least a longitudinal end portion of the insulator body adjacent to its firing end. The ground electrode further includes a toroidal member having a convex outer surface. The toroidal member is supported by and spaced from the support portion of the sleeve. The toroidal member forms an annular curve disposed generally in a plane transverse to and having a radial center coinciding with the central axis of the insulator body, whereby each differential segment of the toroidal member radially thereabout is generally equidistant to the firing tip. The toroidal member is a closest portion of the ground electrode relative to the firing tip. At least a portion of the outer surface of the toroidal member opposing the firing tip has a radius of curvature of about that of the firing tip for providing a spark along a path of least resistance from the firing tip of the sparking electrode to a point of contact on the opposing surface defined by the toroidal member of the ground electrode.

In a second aspect of the present invention, a spark plug includes an elongated electrical insulator body defining a first bore extending longitudinally along a central axis of the body from a connector end to a firing end. A sparking electrode communicates with the first bore. The sparking electrode includes a firing tip defining a convex outer surface facing generally away from the connector end and generally has a radius of curvature. The firing tip has an outermost point generally coinciding with the central axis;. A ground electrode includes a sleeve having a support portion adjacent to the firing tip of the sparking electrode. The sleeve defines a second bore accommodating at least a longitudinal end portion of the insulator body adjacent to its firing end. The ground electrode further includes a toroidal member having a convex outer surface. The toroidal member is supported by and spaced from the support portion of the sleeve such that the toroidal member is disposed slightly longitudinally outwardly from the firing tip. The toroidal member forms an annular curve disposed generally in a plane transverse to and having a radial center coinciding with the central axis of the insulator body, whereby each differential segment of the toroidal member radially thereabout is generally equidistant to the firing tip. The toroidal member is a closest portion of the ground electrode relative to the firing tip. At least a portion of the outer surface of the toroidal member opposing the firing tip has a radius of curvature of about that of the firing tip for providing a spark along a path of least resistance from the firing tip of the sparking electrode to a point of contact on the opposing surface defined by the toroidal member of the ground electrode.

In a third aspect of the present invention, a spark plug includes an elongated electrical insulator body defining a first bore extending longitudinally along a central axis of the body from a connector end to a firing end. A sparking electrode communicating with the first bore. The sparking electrode includes a firing tip defining a convex outer surface facing generally toward the connector end and generally having a radius of curvature. The firing tip has an outermost point generally coinciding with the central axis. A ground electrode includes a sleeve having a support portion adjacent to the firing tip of the sparking electrode. The sleeve defines a second bore accommodating at least a longitudinal end portion of the insulator body adjacent to its firing end. The ground electrode further includes a toroidal member having a convex outer surface. The toroidal member is supported by and spaced from the support portion of the sleeve such that the toroidal member is disposed slightly longitudinally inwardly from the firing tip. The toroidal member forms an annular curve disposed generally in a plane transverse to and having a radial center coinciding with the central axis of the insulator body, whereby each differential segment of the toroidal member radially thereabout is generally equidistant to the firing tip. The toroidal member is a closest portion of the ground electrode relative to the firing tip. At least a portion of the outer surface of the toroidal member opposing the firing tip has a radius of curvature of about that of the firing tip for providing a spark along a path of least resistance from the firing tip of the sparking electrode to a point of contact on the opposing surface defined by the toroidal member of the ground electrode.

One advantage of the present invention is that the spark gap between electrodes need be set only once during the manufacture of the spark plug.

Another advantage of the present invention is that the connecting members and the toroidal member cooperate to form a cage or frustoconically shaped enclosure which protects the firing tip of the sparking electrode and the insulator body from mechanical damage resulting from, for example, accidentally dropping the spark plug.

A further advantage of the present invention is that the connecting members permit the insulator body to be exposed to the atmosphere and to cleaning from the fuel/air blast created by a spark to prevent the accumulation of carbon thereon.

A further advantage of the present invention is that the spark plug provides a plurality of generally radial spark paths terminating about the surface of the toroidal member which significantly extends the operational life of the spark plug.

Another advantage of the present invention is that the firing tip of the sparking electrode protects the longitudinal end of the insulator body from damage from the fuel/air blast.

DETAILED DESCRIPTION OF THE PREFERRED EMBODIMENTS

Figure 1:
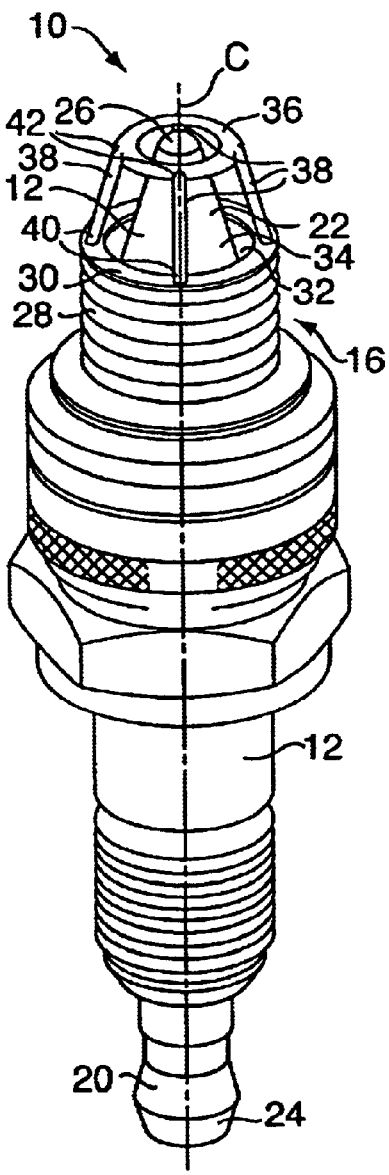
FIG. 1 is a perspective view of a spark plug embodying the present invention.
Figure 2:
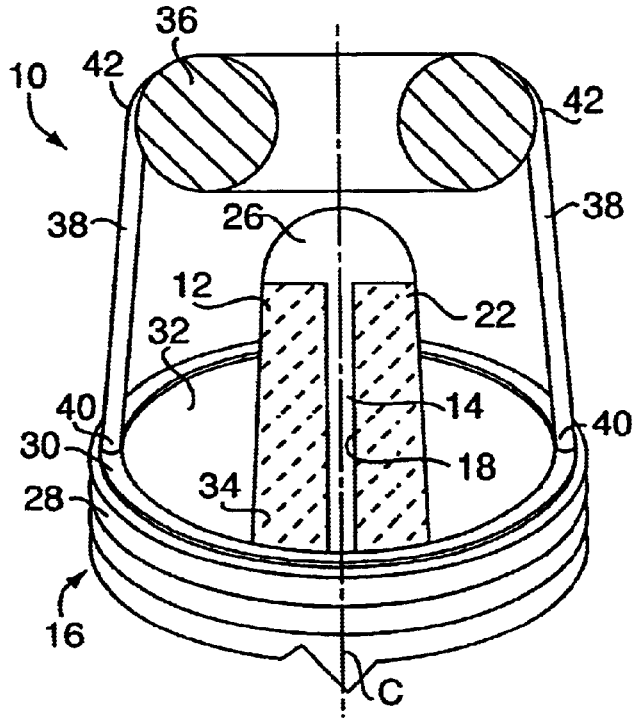
FIG. 2 is a partial cross-sectional view of the firing end of the spark plug of FIG. 1.

With reference to FIGS. 1 and 2, a spark plug embodying the present invention is generally designated by the reference number 10. The spark plug includes an elongated electrical insulator body 12, a sparking electrode 14 and a ground electrode 16.

The insulator body 12, preferably a ceramic material, defines a first bore 18 extending longitudinally along a central axis C of the insulator body from a connector end 20 to a firing end 22 of the insulator body. The sparking electrode 14 has a terminal end 24 at the connector end 20 of the insulator body 12, and at an opposite end an exposed firing tip 26. The firing tip 26 defines a convex outer surface generally having a radius of curvature and is preferably in the form of a dome or half-sphere at least partly covering the firing end 22 of the insulator body 12 to provide maximum resistance to spark bleed off before spark firing, and to protect the insulator body 12 from damaging effects of the ignition of a fuel/air mixture in an internal combustion engine (not shown). As shown in FIGS. 1 and 2, the convex outer surface of the firing tip 26 faces generally away from the connector end 20 of the insulator body 12. The sparking electrode 14 is substantially disposed within the first bore 18 such that the terminal end 24 extends slightly longitudinally outwardly from the connector end 20 of the insulator body 12 for connection to the boot of a spark plug cable (not shown), and the firing tip 26 extends slightly longitudinally outwardly from the firing end 22 of the insulator body for immersion in a fuel/air mixture in a firing chamber of an internal combustion engine. As shown in FIG. 2, the center of the firing tip 26 of the sparking electrode 14 coincides with the central axis C of the insulator body 12.

The ground electrode 16 includes a sleeve 28 having a support portion 30 positioned adjacent to the firing tip 26 of the sparking electrode 14. The sleeve 28 defines an external threaded surface for being threadably received in the cylinder head of an internal combustion engine (not shown), and defines a second bore 32 accommodating at least a longitudinal end portion 34 of the insulator body 12 adjacent to the firing end 22. The ground electrode 16 further includes an electrically conductive toroidal member 36 having a convex outer surface, preferably in the form of a torus. At least two electrically conductive connecting members 38, 38, preferably four as shown in FIG. 1, couple the toroidal member 36 to the support portion 30 of the ground electrode 16. More specifically, each of the connecting members 38, 38 has a first end 40 coupled to the support portion 30 of the ground electrode 16, and a second end 42 coupled to a portion of the toroidal member 36. As best shown in FIG. 2, the connecting members 38,38 each taper inwardly toward the central axis C in a direction from the first end 40 to the second end 42. As a result, the toroidal member 36 is the closest portion of the ground electrode 16 relative to the firing tip 26 of the sparking electrode 14. At least a portion of the outer surface of the toroidal member 36 facing the firing tip 26 has a radius of curvature of about that of the firing tip, to thereby provide a spark path of least resistance from the firing tip of the sparking electrode to a point of contact on the toroidal member. It has been found that the firing tip 26 when in the form of a dome or half-sphere, and the toroidal member 36 both having a similar radius of curvature cooperate to provide inherent maximum electrical stiction (i.e., allows equivalent ball to ball spark firing) to prevent spark bleed off before a spark fires so that maximum spark enhancement (i.e., hottest spark) occurs.

As shown in FIGS. 1 and 2, the toroidal member 36 forms an annular curve disposed generally in a plane transverse to and having a radial center coinciding with the central axis C of the insulator body 12 such that each differential segment of the toroidal member radially thereabout is generally equidistant to the firing tip 26. As a result, a spark path can be terminated at any point radially about the toroidal member 36. Further, the toroidal member 36 is disposed longitudinally adjacent to, and more specifically as shown in FIGS. 1 and 2, slightly longitudinally outwardly from the firing tip 26 of the sparking electrode 14 such that the connecting members 38, 38 and the toroidal member cooperate to form a cage or frustoconically shaped vented enclosure. The frustoconically shaped vented enclosure about the firing tip 26 allows the pre-explosion fuel/air mixture to sufficiently cool the spark plug insulator end to eliminate hot spot problems (i.e., cracking the insulator) associated with prior radially directed spark plugs. The frustoconically shaped vented enclosure also creates an additional fuel/air mixture explosion wind around the firing tip 26 and the toroidal member 36 to substantially prevent carbon build-up on the tip and the toroidal member. Moreover, the enclosure protects the firing tip 26 of the sparking electrode 14 and the insulator body 12 from mechanical damage resulting from, for example, accidentally dropping the spark plug.

In operation, when a spark is generated between the electrodes 14 and 16, it extends along a path of least resistance. The path of least resistance is generally the shortest path between the firing tip 26 of the sparking electrode 14 and the ground electrode 16. As shown in FIGS. 1 and 2, the shortest distance generally is between a point of contact from a side portion circumferentially about the dome of the firing tip 26 and a point of contact radially about the toroidal member 36 from the portion of the outer surface of the toroidal member facing the firing tip. As mentioned above, a spark path has a termination point at a side portion of the dome of the firing tip 26 because the side portion is closer to the toroidal member 36 relative to the outermost point of the dome coinciding with the central axis C.

The exact termination points of a spark path at a first end radially about the dome and at a second end radially about the toroidal member are determined by a variety of factors including fuel fluctuations and slight point-to-point variations in distance between the firing tip 26 and the toroidal member 36. For example, if a contact point for a spark on the toroidal member 36 deteriorates because of electrical spark contact corrosion (pitting), the spark gap will slightly increase which slightly lowers conductivity at this point. As a result, the path of least resistance now may be at another point on the toroidal member 36 that has not yet been contacted by a spark.

The provision of a plurality of contact points for each end of a spark path significantly extends the operational life of the spark plug 10. Because the spark plug 10, in effect, supplies new contact points, regapping which is common for conventional spark plugs using point-to-point electrodes is not necessary with the spark plug embodying the present invention. The gap between the firing tip 26 of the sparking electrode 14 and the toroidal member 36 of the ground electrode 16 need be set only once during manufacture, and such factory setting of the gap is sufficient for the operational life of the spark plug 10.

Figure 3:
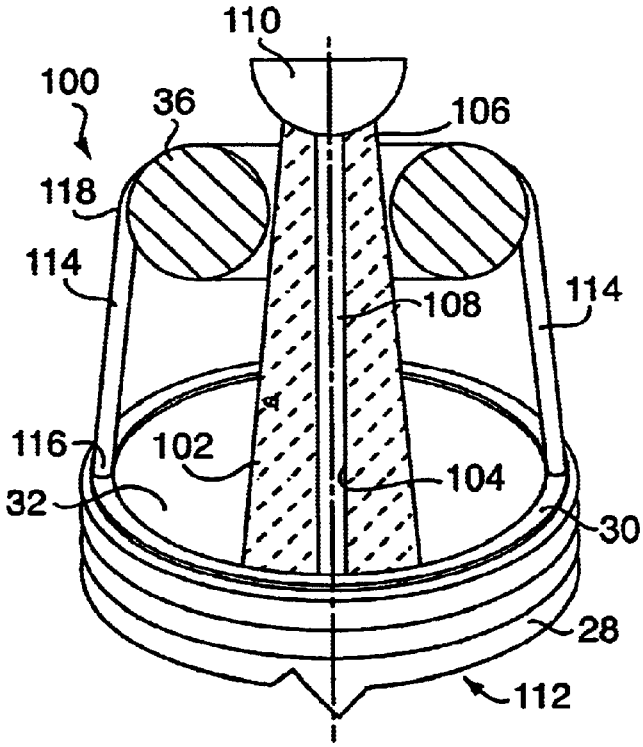
FIG. 3 is a partial cross-sectional view of the firing end of a spark plug in accordance with a second embodiment of the present invention.

FIG. 3 is a partial cross-sectional view of a firing end of a spark plug 100 in accordance with a second embodiment of the present invention. Like elements with the spark plug 10 of FIGS. 1 and 2 are designated by like reference numbers.

An insulator body 102 defines a first bore 104 extending longitudinally along a central axis C of the insulator body from a connector end (not shown) to a firing end 106 of the insulator body. A sparking electrode 108 has a terminal end (not shown) at the connector end of the insulator body 102, and at an opposite end an exposed firing tip 110. The firing tip 110 defines a convex outer surface generally having a radius of curvature and is preferably in the form of a dome or half-sphere at least partly covering the firing end 106 of the insulator body 102 to provide maximum resistance to spark bleed off before spark firing, and to protect the insulator body 102 from damaging effects of the ignition of a fuel/air mixture in an internal combustion engine (not shown). As shown in FIG. 3, the convex outer surface of the firing tip 110 faces generally toward the connector end of the insulator body 102, as opposed to spark plug 10 of FIGS. 1 and 2 where the convex outer surface of the firing tip 26 faces generally away from the connector end 20 of the insulator body 12. The sparking electrode 108 is substantially disposed within the first bore 104 such that a terminal end extends slightly longitudinally outwardly from the connector end (not shown) of the insulator body 102 for connection to the boot of a spark plug cable, and the firing tip 110 extends slightly longitudinally outwardly from the firing end 106 of the insulator body for immersion in a fuel/air mixture in a firing chamber of an internal combustion engine. As shown in FIG. 3, the center of the firing tip 110 of the sparking electrode 108 coincides with the central axis C of the insulator body 102.

The spark plug 100 further includes a sleeve 28 having a support portion 30 positioned adjacent to the firing tip 110 of the sparking electrode 108. A ground electrode 112 includes an electrically conductive toroidal member 36 having a convex outer surface, preferably in the form of a torus. At least two electrically conductive connecting members 114, 114 couple the toroidal member 36 to the support portion 30 of the ground electrode 112. More specifically, each of the connecting members 114, 114 has a first end 116 coupled to the support port of the insulator body.

What is claimed is:

1. A spark plug comprising:

an elongated electrical insulator body defining a first bore extending longitudinally along a central axis of the body from a connector end to a firing end;

a sparking electrode communicating with the first bore, the sparking electrode including a firing tip defining a convex outer surface generally having a radius of curvature, the firing tip having an outermost point gwerally coinciding with the central axis; and a ground electrode including a sleeve having a support portion adjacent to the firing tip of the sparking electrode, the sleeve defining a second bore accommodating at least a longitudinal end portion of the insulator body adjacent to its firing end, the ground electrode further including a toroidal membcr having a convex outer surface, the toroidal member being supported by and spaced from the support portion of the sleeve, the toroidal member forming an annular curve disposed generally in a plane transverse to and having a radial center coinciding with the central axis of the insulator body, whereby each differential segment of the toroidal member radially thereabout is generally equidistant to the firing tip, the toroidal member being a closest portion of the ground electrode relative to the firing tip, and at least a portion of thc outer surface of the toroidal member opposing the firing tip having a radius of curvature of about that of the firing tip for providing a spark along a path of least resistance from the firing tip of the sparking electrode to a point of contact on the opposing surface defined by the toroidal member of the ground electrode.

2. A spark plug as defined in claim 1, wherein the convex outer surface of the firing tip faces generally away from the connector end of the electrical insulator body.

3. A spark plug as defined in claim 1, wherein the convex outer surface of the firing tip faces generally toward the connector end of the electrical insulator body.

4. A spark plug as defined in claim wherein the toroidal member is disposed slightly longitudinally outwardly from the firing tip of the sparking electrode.

5. A spark plug as defined in claim 3, wherein the toroidal member is disposed slightly longitudinally inwardly from me firing tip of the sparking electrode.

6. A spark ping as defined in claim 1, further including at least two elongated connecting members each having a first end coupled to the support portion of the sleeve and a second end coupled to a portion of the toroidal member for positioning the toroidal member adjacent to thc firing tip of the sparking electrode.

7. A spark ptug as defined in claim 6, wherein the connecting members each taper inwardly toward the central axis from the first end to the second end.

8. A spark plug as defined in claim 7, wherein the toroidal member is disposed slightly longitudinally outwardly from the firing tip of the sparking electrode, whereby the connecting members and the toroidal member cooperate to form a protective cage for the firing tip of the sparking electrode.

9. A spark plug as defined in claim 1, further including four elongMed connecting members each having a first end coupled to the support portion of the sleeve and a second end coupled to a portion of the toroidal member for positioning the loroidal member adjacent to the firing tip of the sparking electrode, the elongated members being evenly spaced relative to each other about the central axis of the insulator body.

10. A spark plug as defined in claim 9, wherein the connecting members each taper inwardly toward the central axis from the first end to the second end.

11. A spark plug as defined in claim 10, wherein the toroidal member is disposed slightly longitudinally outwardly from the firing tip of the sparking electrode, whereby the connecting members and the toroidal member cooperate to form a protective cage for the firing tip of the sparking electrode.

12. A spark plug as defined in claim 1, wherein the firing tip of the sparking electrode forms a dome at least partly covering the firing end of the insulator body, whereby a spark has a point of contact on any side portion of the dome.

13. A spark plug as defined in claim 1, wherein the firing tip of the sparking electrode forms a half-sphere at least partly covering the firing end of the insulator body, whereby a spark has a point of contact on any side portion of the half-sphere.

14. A spark plug as defined in claim 1, wherein the insulator body is a ceramic material.

15. A spark plug as defined in claim 1, wherein the toroidal member is a torus.

16. A spark plug comprising:

an elongated electrical insulator body defining a first bore extending longitudinally along a central axis of the body from a connector end to a firing end;

a sparking electrode communicating with the first bore, the sparking electrode including a firing tip defining a convex outer surface facing generally away from the connector end and generally having a radius of curvature, the firing tip having an outermost point generally coinciding with the central axis; and a ground electrode including a sleeve having a support portion adjacent to the firing tip of the sparking electrode, the sleeve defining a second bore accommodating at least a longitudinal end portion of the insulator body adjacent to its firing end, the ground electrode further including a toroidal member having a convex outer surface, the toroidal member being supported by and spaced from the support portion of the sleeve such that the toroidal member is disposed slightly longitudinally outwardly from the firing tip, the toroidal member forming an annular curve disposed generally in a plane transverse to and having a radial center coinciding with the central axis of the insulator body, whereby each differential segment of the toroidal member radially thereabout is generally equidistant to the firing tip, the toroidal member being a closest portion of the ground electrode relative to the firing tip, and at least a portion of the outer surface of the toroidal member opposing the firing tip having a radius of curvature of about that of the firing tip for providing a spark along a path of least resistance from the firing tip of the sparking electrode to a point of contact on the opposing surface defined by the toroidal member of the ground electrode.

17. A spark plug as defined in claim 16, further including four elongated connecting members each having a first end coupled to the support portion of the sleeve and a second end coupled to a portion of the toroidal member for positioning the toroidal member adjacent to the firing tip of the sparking electrode, the elongated members being evenly spaced relative to each other about the central axis of the insulator body, whereby the connecting members and the toroidal member cooperate to form a protective cage for the firing tip of the sparking electrode.

18. A spark plug as defined in claim 17, wherein the connecting members each taper inwardly toward the central axis from the first end to the second end.

19. A spark plug comprising:

an elongated electrical insulator body defining a first bore extending longitudinally along a central axis of the body from a connector end to a firing end;

a sparking electrode communicating with the first bore, the sparking electrode including a firing tip defining a convex outer surface facing generally toward the connector end and generally having a radius of curvature, the firing tip having an outermost point generally coinciding with the central axis; and a ground electrode including a sleeve having a support portion adjacent to the firing tip of the sparking electrode, the sleeve defining a second bore accommodating at least a longitudinal end portion of the insulator body adjacent to its firing end, the ground electrode further including a toroidal member having a convex outer surface, the toroidal member being supported by and spaced from the support portion of the sleeve such that the toroidal member is disposed slightly longitudinally inwardly from the firing tip, the toroidal member forming an annular curve disposed generally in a plane transverse to and having a radial center coinciding with the central axis of the insulator body, whereby each differential segment of the toroidal member radially thereabout is generally equidistant to the firing tip, the toroidal member being a closest portion of the ground electrode relative to the firing tip, and at least a portion of the outer surface of the toroidal member opposing the firing tip having a radius of curvature of about that of the firing tip for providing a spark along a path of least resistance from the firing tip of the sparking electrode to a point of contact on the opposing surface defined by the toroidal member of the ground electrode.

* * * * *

UNITED STATES PATENT AND TRADEMARK OFFICE

CERTIFICATE OF CORRECTION

PATENT NO. : 6,670,740 B2
DATED : December 30, 2003
INVENTOR(S) : William W. Landon, Jr.

It is certified that error appears in the above-identified patent and that said Letters Patent is hereby corrected as shown below:

Column 6,
Line 31, please remove “gwerally” and replace it with -- generally --.
Line 60, after the word “claim”, please insert -- 1, --.
Line 65, please remove “me” and replace it with -- the --.
Line 66, please remove “ping” and replace it with -- plug --.

Column 7,
Line 5, please remove “ptug” and replace it with -- plug --.
Line 14, please remove “elongMed” and replace it with -- elongated --.
Line 17, please remove “loroidal” and replace it with -- toroidal --.

Signed and Sealed this

Twenty-third Day of March, 2004

JON W. DUDAS
*Acting Director of the United States Patent and Trademark Office*